US008325110B2

(12) United States Patent
Yoon et al.

(10) Patent No.: US 8,325,110 B2
(45) Date of Patent: Dec. 4, 2012

(54) POWER SUPPLY AND DRIVER FOR PLASMA DISPLAY PANEL

(75) Inventors: Bong-Eun Yoon, Suwon-si (KR); Sang-Min Nam, Suwon-si (KR); Jung-Pil Park, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1076 days.

(21) Appl. No.: 12/036,456

(22) Filed: Feb. 25, 2008

(65) Prior Publication Data

US 2008/0218504 A1 Sep. 11, 2008

(30) Foreign Application Priority Data

Mar. 6, 2007 (KR) ..... 10-2007-0022144

(51) Int. Cl.
*G09G 3/28* (2006.01)

(52) U.S. Cl. ..... 345/60

(58) Field of Classification Search ..... 345/60–72, 345/204, 211–215; 315/169.1–169.4; 313/231.31
See application file for complete search history.

(56) References Cited

U.S. PATENT DOCUMENTS 6,686,912 B1 * 2/2004 Kishi et al. ..... 345/211
6,744,218 B2 6/2004 Kang et al.
6,924,779 B2 * 8/2005 Lee et al. ..... 345/60
7,158,101 B2 * 1/2007 Lee et al. ..... 345/60
7,161,564 B2 * 1/2007 Lee et al. ..... 345/60
7,173,579 B2 2/2007 Lee

FOREIGN PATENT DOCUMENTS

KR 2000-27756 5/2000
KR 2003-78214 10/2003

OTHER PUBLICATIONS

Korean Office Action issued on Dec. 13, 2007 by the Korean Patent Office.

* cited by examiner

*Primary Examiner* — Amare Mengistu
*Assistant Examiner* — Rodney Amadiz
(74) *Attorney, Agent, or Firm* — Christie, Parker & Hale, LLP

(57) ABSTRACT

A plasma display panel having a power supply unit connected to a scan driver without a bootstrap circuit. The driver includes a power supply unit supplying a first output voltage of a first level and has a pair of output terminals, a scan driving unit comprising a first driving switch controlling the connection of one of output terminals of the power supply unit to the electrodes of the plasma display panel and a second driving switch controlling the application of a second output voltage of a second level to the electrodes of the plasma display panel, and a third driving switch that controls the connection of a power input terminal of the second output voltage of the second level to the electrodes of the plasma display panel by being connected between the power input terminal of the second output voltage of the second level and the second driving switch.

18 Claims, 6 Drawing Sheets

POWER SUPPLY AND DRIVER FOR PLASMA DISPLAY PANEL

CROSS-REFERENCE TO RELATED APPLICATIONS

This application claims the benefit of Korean Patent Application No. 2007-22144, filed Mar. 6, 2007, in the Korean Intellectual Property Office, the disclosure of which is incorporated herein in its entirety by reference.

BACKGROUND OF THE INVENTION

1. Field of the Invention

Aspects of the present invention relate to a driver for a plasma display panel, and more particularly, to a driver for a plasma display panel in which the plasma display panel is scan driven by a switch driving control of a scan drive IC of a scan drive unit which receives an output power of a direct current to direct current conversion unit.

2. Description of the Related Art

Plasma display panels (PDPs) are flat panel display apparatuses that display images using discharge effects and are popular due to a large size screen, which is easily manufactured. PDPs can be classified into direct current (DC) PDPs and alternating current (AC) PDPs according to the discharge voltage type. The DC PDPs suffer from a long delay time for a discharge time. Therefore, much research is dedicated to PDPs driven by alternating current.

An example of the AC PDP is a three-electrode AC surface discharge type PDP that is driven by three electrodes and an alternating current. A conventional three-electrode AC surface discharge type PDP comprises multiple layers of plates, and thus, is thin and lightweight and can provide a larger screen size as compared to a conventional cathode ray tube (CRT). Therefore, the three-electrode AC surface discharge type PDP has a spatial advantage over the conventional CRT.

A three-electrode surface discharge type PDP as an example of a conventional PDP, a driver for the three-electrode surface discharge type PDP, and a method of operating the same have been disclosed in Kang et al., in U.S. Pat. No. 6,744,218, under the title of "Method of driving a plasma display panel in which the width of display sustain pulse varies."

A PDP includes a plurality of display cells. Each of the display cells consists of three discharge cells (red, green, and blue colors), and a gray scale of an image is displayed by controlling the discharge states of the discharge cells.

In order to display a gray scale of an image of a PDP, a frame of the PDP can be expressed in 256 gray scales comprising eight subfields having different flash frequencies. That is, in order to display an image with 256 gray scales, a frame (16.67 ms) corresponding to 1/60 second is divided into eight subfields having different flash frequencies. In each of the subfields, a reset period, an address period, and a sustain discharge period are present to drive the PDP.

A driver of the PDP applies power to each of the electrodes of the PDP in each of the driving periods. In the address period, a scan signal is sequentially applied to the scan electrodes, and discharge cells are selected by applying data signals in response to the scan signals to the corresponding address electrodes of the discharge cells. The discharge cells are organized and appropriately selected for discharge to form and display a static or dynamic image.

For this purpose, the scan electrodes are biased to a scan high voltage in the address period, and a scan signal of a scan low voltage is sequentially applied to the scan electrodes. A circuit that allows the scan signal to be sequentially applied to the scan electrodes is necessary when the scan electrodes are biased to the scan high voltage in the address period. Circuits that provide such functionality are generally complex and use a bootstrap circuit.

SUMMARY OF THE INVENTION

Aspects of the present invention provides a driver for a plasma display panel having a simplified driving circuit by supplying an output power of a direct current to direct current conversion unit to a scan drive IC of a scan drive unit without using a bootstrap charge method.

According to an aspect of the present invention, there is provided a driver that drives a plasma display panel by applying a voltage to electrodes of the plasma display panel, the driver comprising: a power supply unit supplying a first output voltage of a first level and has a pair of output terminals; a scan driving unit comprising a first driving switch that controls the connection of one of the output terminals of the power supply unit to the electrodes of the plasma display panel and a second driving switch that controls the application of a second output voltage of a second level to the electrodes of the plasma display panel; and a third driving switch that controls the connection of a power input terminal of the second output voltage of the second level to the electrodes of the plasma display panel by being connected between the power input terminal of the second output voltage of the second level and the second driving switch.

The other terminal of the output terminals of the power supply unit may be connected between the second driving switch and the third driving switch.

A voltage corresponding to the sum of the first output voltage and the second output voltage of the first and second levels may be applied to the electrodes of the plasma display panel when the first driving switch is ON.

The second driving switch may be in an OFF operation when the first driving switch is ON.

The driver may further comprise a capacitor connected between a grounding terminal and a terminal between the second driving switch and the third driving switch.

The power supply unit may comprise: a direct current generation unit that converts an input alternating current voltage into a direct current voltage of a third level; and a DC to DC conversion unit that converts the direct current voltage of the third level into a first output voltage.

According to another aspect of the present invention, there is provided a driver for driving a plasma display panel in such a way that a plurality of subfields of respective gray scale weighted values are present in each frame which is a display unit to display time division gray scales; a reset period, an address period, and a sustain period are present in each of the plurality of subfields; scan signals are sequentially applied to scan electrodes in the address period; and a discharge cell on which an image is displayed is selected by applying data signals in response to the scan signal to the corresponding address electrodes of the discharge cells where an image is displayed, the driver comprising: a power supply unit that supplies a first output voltage of a first level and has a pair of output terminals; a scan driving unit that comprises a first driving switch that controls the connection of one of the pair of output terminals of the power supply unit to the electrodes of the plasma display panel and a second driving switch that controls the application of a second output voltage of a second level to the electrodes of the plasma display panel; and a third driving switch that controls the connection of a power input terminal of the second output voltage to the electrodes of the plasma display panel by being connected between the power input terminal of the second output voltage and the second driving switch.

The driver may further comprise a third driving switch that controls the connection of a power input terminal of the second output voltage to the electrodes by being connected between the power input terminal of the second output voltage and the second driving switch.

The scan electrodes may be biased to a third level voltage in the address period, and the scan signals may be sequentially applied to the scan electrodes.

The third level voltage may correspond to a voltage corresponding to the sum of the first output voltage and the second output voltage of the first level and the second levels.

The scan signal may be the second output voltage of the second level.

According to aspects of the present invention, a driving circuit may be simplified by directly applying an output voltage of the DC to DC conversion unit to a scan drive IC without passing through a bootstrap charge system.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
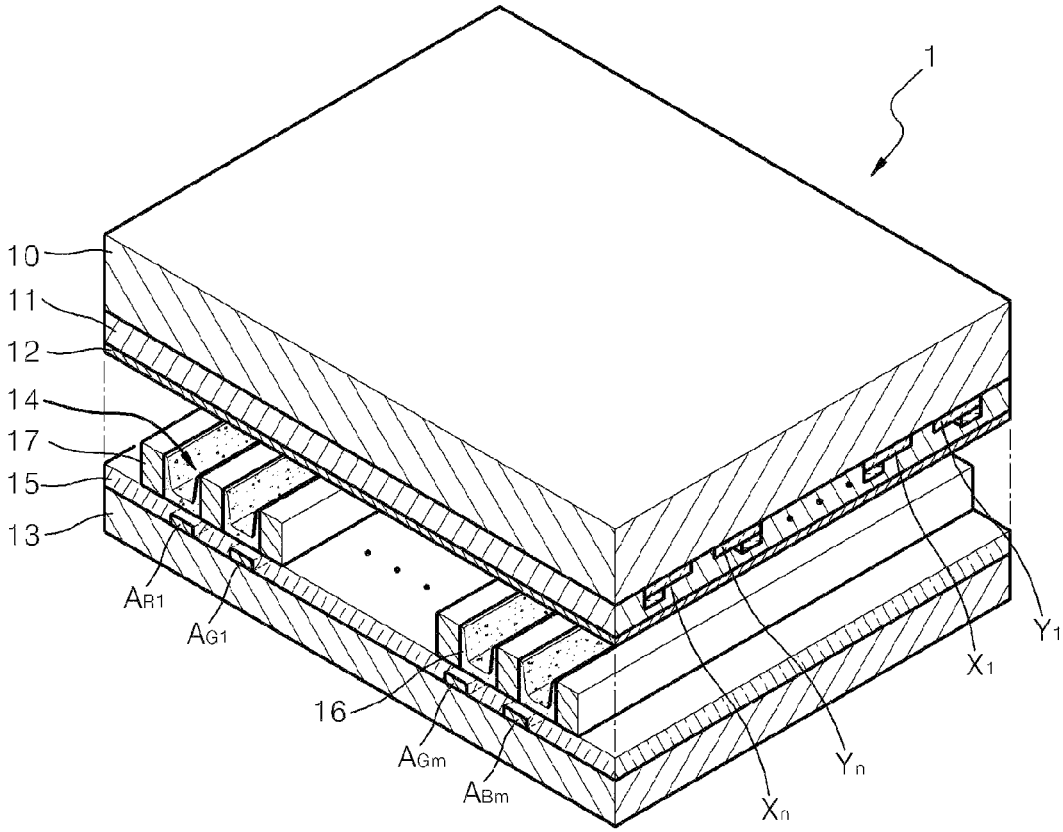
FIG. 1 is a perspective view illustrating a structure of a three-electrode surface discharge type plasma display panel (PDP) according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is an inner perspective view illustrating a structure of a three-electrode surface discharge type plasma display panel (PDP) 1 according to aspects of the present invention. Referring to FIG. 1, address electrodes lines $A_{R1}$ through $A_{Bm}$, upper and lower dielectric layers 11 and 15, Y electrodes $Y_1$ through $Y_n$, X electrodes $X_1$ through $X_n$, a phosphor layer 16, barrier ribs 17, and an MgO layer 12 as a protective layer are formed between front and rear glass substrates 10 and 13 of the three-electrode surface discharge type PDP 1.

The address electrodes $A_{R1}$ through $A_{Bm}$ are formed in a predetermined pattern on a front surface of the rear glass substrate 13. The lower dielectric layer 15 is coated on the entire front surface of the address electrodes $A_{R1}$ through $A_{Bm}$ to cover the entire front surface of the address electrodes $A_{R1}$ through $A_{Bm}$. The address electrodes $A_{R1}$ through $A_{Bm}$ comprise electrodes dedicated to red, green, and blue emitting phosphors and sequentially repeat m times from $A_{R1}$, $A_{G1}$, $A_{B1}$, $A_{R2}$, $A_{G2}$, $A_{B2}$ up to $A_{Rm}$, $A_{Gm}$, and $A_{Bm}$. The barrier ribs 17 are formed on an upper surface of the lower dielectric layer 15 and parallel to the address electrodes $A_{R1}$ through $A_{Bm}$. The barrier ribs 17 define discharge regions of each of the discharge cells 14 and prevent optical cross-talk between each of the discharge cells 14. The phosphor layer 16 is formed in a space formed between the lower dielectric layer 15 and the barrier ribs 17 that are formed on the rear glass substrate 13. Specifically, the phosphor layer 16 is formed along the sides of the barrier ribs 17 and on the surface of the lower dielectric layer 15 between the barrier ribs 17.

The X electrodes $X_1$ through $X_n$ and the Y electrodes $Y_1$ through $Y_n$ are formed in a predetermined pattern on a rear surface of the front glass substrate 10 crossing the address electrodes $A_{R1}$ through $A_{Bm}$. Points at which the X electrodes $X_1$ through $X_n$ and the Y electrodes $Y_1$ through $Y_n$ cross the address electrodes $A_{R1}$ through $A_{Bm}$ allows for the selection of the discharge cells 14 corresponding to the points at which the electrodes cross. Each of the X electrodes $X_1$ through $X_n$ and the Y electrodes $Y_1$ through $Y_n$ is formed by combining a transparent electrode formed of a transparent conductive material such as indium tin oxide (ITO) and a metal electrode to increase conductivity of the X electrodes $X_1$ through $X_n$ and the Y electrodes $Y_1$ through $Y_n$. However, the PDP 1 is not limited thereto. The X electrodes $X_1$ through $X_n$, the Y electrodes $Y_1$ through $Y_n$, and the address electrodes $A_{R1}$ through $A_{Bm}$ can be disposed in the barrier ribs 17 instead on the surfaces of the front and rear glass substrates 10 and 13. As such, the electrodes may be formed of electrodes having higher conductivity than the transparent electrodes.

The X electrodes $X_1$ through $X_n$ are sustain electrodes in each of the discharge cells 14, the Y electrodes $Y_1$ through $Y_n$ are scan electrodes in each of the discharge cells 14, and the address electrodes $A_{R1}$ through $A_{Bm}$ are address electrodes in each of the discharge cells 14. At this point, the Y electrodes $Y_1$ through $Y_n$ are scan electrodes to which a scan pulse is sequentially applied in order to select discharge cells that are to be displayed.

Figure 2:
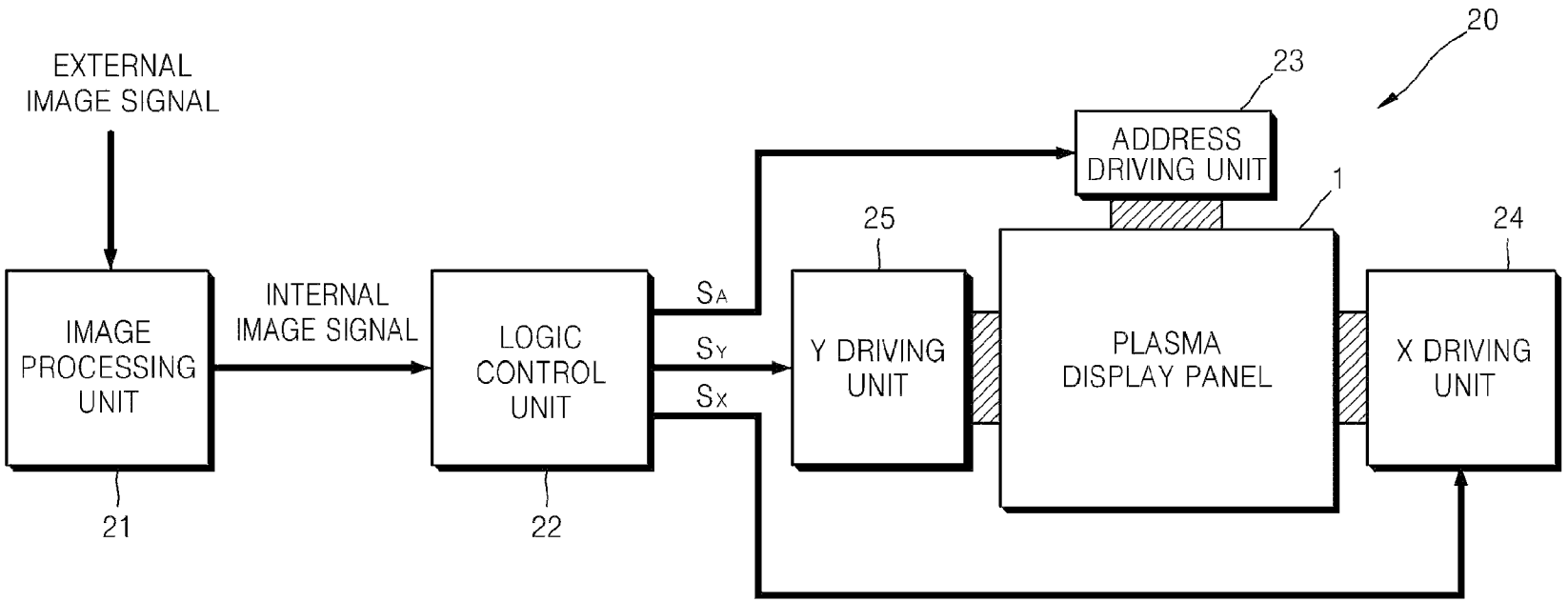
FIG. 2 is a simplified block diagram illustrating a driver for the PDP of FIG. 1.

FIG. 2 is a simplified block diagram illustrating a driver 20 for a PDP 1 according to aspects of the present invention. Referring to FIG. 2, the driver 20 of the three-electrode surface discharge type PDP 1 includes an image processing unit 21, a logic control unit 22, an address driving unit 23, an X driving unit 24, and a Y driving unit 25. The image processing unit 21 generates internal image signals by transforming external analog image signals to digital signals. The internal image signals can be, respectively, eight bits of red R, green G, and blue B image data. The internal image signals can also include clock signals and vertical and horizontal synchronizing signals. The logic control unit 22 generates driving control signals $S_A$, $S_Y$, and $S_X$ according to the internal image signals received from the image processing unit 21. The driving control signal $S_A$ is applied to the address driving unit 23. The driving control signal $S_Y$ is applied to the Y driving unit 25. The driving control signal $S_X$ is applied to the X driving unit 24.

At this point, the address driving unit 23, the X driving unit 24, and the Y driving unit 25 respectively generate driving signals according to the driving control signals $S_A$, $S_Y$, and $S_X$ from the logic control unit 22. The address driving unit 23 generates and applies the generated driving signals to each of the address electrodes $A_{R1}$ through $A_{Bm}$. The X driving unit 24 generates and applies the generated driving signals to each of the X electrodes $X_1$ through $X_n$. And, the Y driving unit 25 generates and applies the generated driving signals to each of the Y electrodes $Y_1$ through $Y_n$.

More specifically, the address driving unit 23 applies display data signals according to the address signals $S_A$ inputted from the logic control unit 22 to the address electrodes $A_{R1}$ through $A_{Bm}$. The X driving unit 24 applies driving signals to the X electrodes $X_1$ through $X_n$ by processing the X driving control signals $S_X$ inputted from the logic control unit 22. The Y driving unit 25 applies driving signals to the Y electrodes $Y_1$ through $Y_n$ by processing the Y driving control signals $S_Y$ inputted from the logic control unit 22.

The Y driving unit 25 includes a scan driving unit that includes a scan drive IC, and allows the Y electrodes $Y_1$ through $Y_n$ to be applied scan driving signals corresponding to a scan pulse or signal by controlling the switch of the scan drive IC.

Figure 3:
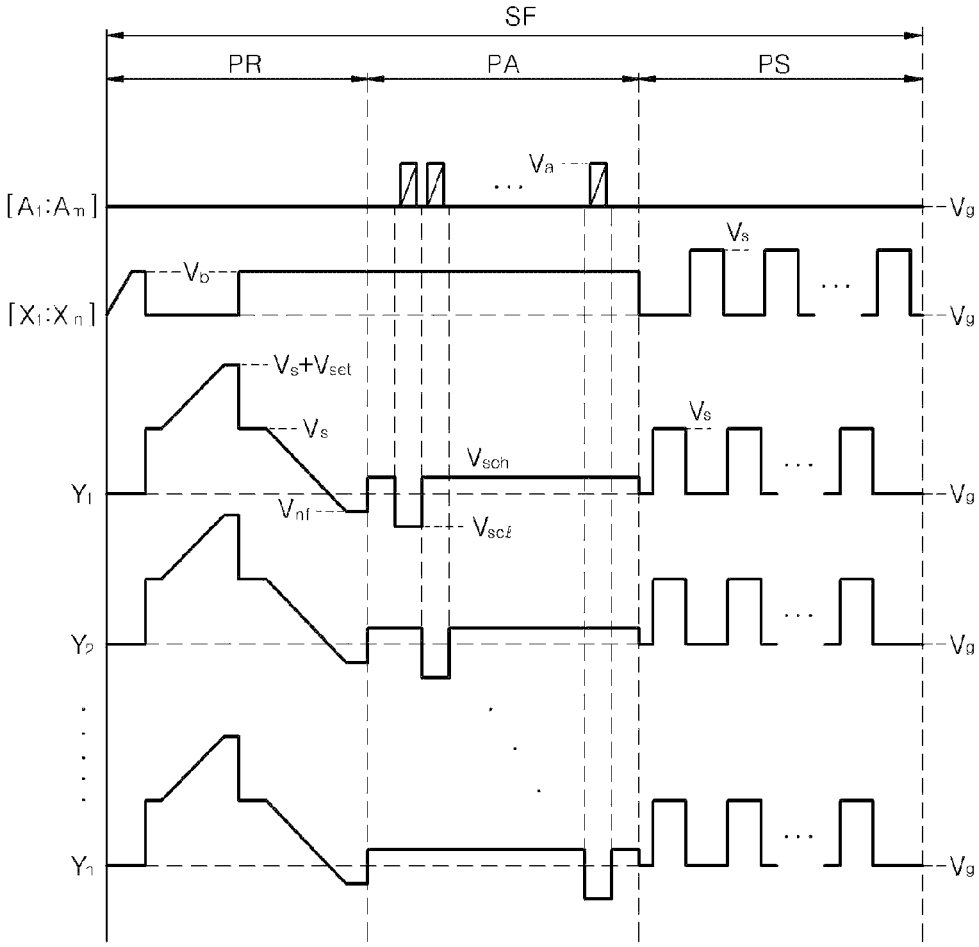
FIG. 3 is a timing diagram illustrating a driving signal applied by each of the driving units of the driver of FIG. 2.

FIG. 3 is a timing diagram showing a driving signal applied by each of the driving units of FIG. 2, according to aspects of the present invention.

Referring to FIG. 3, a unit frame for driving the three-electrode surface discharge type PDP 1 (see FIG. 2) is divided into a plurality of subfields SF, and each of the subfields SF is divided into a reset period PR, an address period PA, and a sustain period PS.

In the reset period PR of the subfields SF, a reset pulse comprised of a rising pulse and a falling pulse is applied to the Y electrodes $Y_1$ through $Y_n$, while a first voltage $V_g$ (a ground voltage) is applied to the X electrodes $X_1$ through $X_n$ corresponding to the rising pulse applied to the Y electrodes $Y_1$ through $Y_n$, and a second voltage $V_b$ (a biased voltage) is applied to the X electrodes $X_1$ through $X_n$ corresponding to the falling pulse applied to the Y electrodes $Y_1$ through $Y_n$. The application of the reset pulse and the first and second voltages generates a reset discharge in the discharge cells. All of the discharge cells in the PDP are initialized by the reset discharge. The rising pulse increases an amount equal to the rising voltage $V_{set}$, and the rising pulse reaches a rising maximum voltage $V_{set}+V_s$ equal to the sum of the rising voltage $V_{set}$ and a sustain discharge voltage $V_s$. The falling pulse falls from the sustain discharge voltage $V_s$ and finally decreases to a falling minimum voltage $V_{nf}$.

In the address period PA, an address discharge is generated by sequentially applying scan pulses or signals to the Y electrodes $Y_1$ through $Y_n$ and simultaneously applying display data signals to the address electrodes $A_1$ through $A_m$. Due to the address discharge, the discharge cells in which sustain discharge will be generated in the sustain period PS are selected. Each of the scan pulses initially has a scan high voltage Vsch and a scan low voltage Vscl having a lower voltage than the scan high voltage Vsch. A display data signal has a positive polarity address voltage Va corresponding in time to the application of the scan low voltage Vscl of the scan pulse.

In the sustain period PS, sustain discharges are generated by alternately applying sustain pulses to the X electrodes $X_1$ through $X_n$ and the Y electrodes $Y_1$ through $Y_n$ while a ground voltage Vg is maintained on the address electrodes $A_1$ through $A_m$. Due to the sustain discharge, a brightness is displayed according to weighted values of a gray scale, which are allocated to each of the subfields SF. The sustain pulse alternately has a sustain discharge voltage Vs and a ground voltage Vg.

Meanwhile, driving signals that are different from the driving signals shown in FIG. 3 can be outputted from the address driving unit 23, the X driving unit 24, and the Y driving unit 25 of the driver 20 of FIG. 2, and the driving signals according to aspects of the present invention are not limited to the driving signals shown in FIG. 3.

Figure 4:
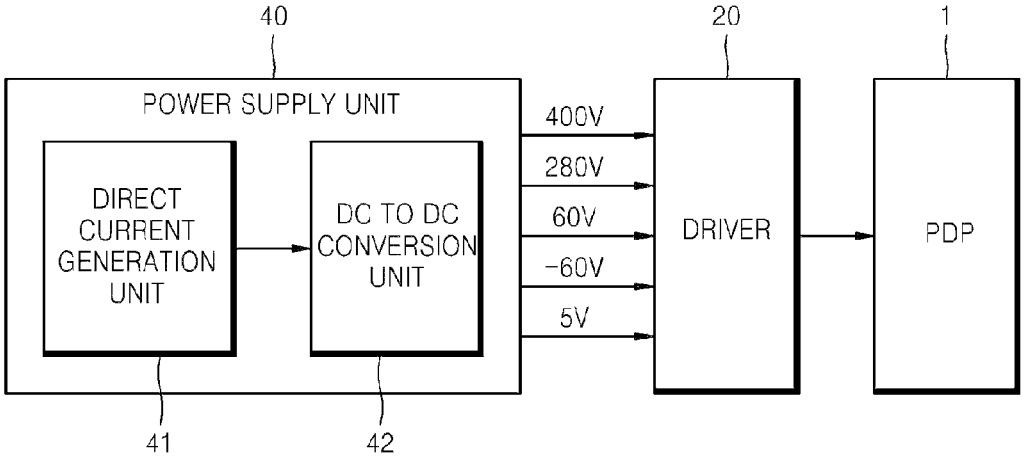
FIG. 4 is a simplified block diagram illustrating a driver for a PDP that drives the PDP by receiving power from a power supply unit.

FIG. 4 is a simplified block diagram illustrating a driver for a PDP that drives the PDP by receiving power from a power supply unit, according to aspects of the present invention.

Referring to FIG. 4, a three-electrode surface discharge type PDP 1 is driven by a driving unit 20 and the driving unit 20 receives power required to drive the three-electrode surface discharge type PDP 1 from a power supply unit 40. The power supply unit 40 is an apparatus that supplies power to the three-electrode surface discharge type PDP 1 that includes the driving unit 20, and includes a direct current generation unit 41 and a direct current to direct current (DC to DC) conversion unit 42.

The direct current generation unit 41 converts an inputted alternating current voltage into a direct current voltage of a third level. The DC to DC conversion unit 42 converts the third level direct current voltage into a first output voltage VscanH of a first level.

The direct current generation unit 41 converts an input alternating current voltage inputted in the form of an alternating current into a direct current voltage and corrects the reduction of power factor that can occur on the direct current voltage. Also, the direct current generation unit 41 outputs an output direct current voltage to the DC to DC conversion unit 42 and increases or decreases the output direct current voltage as required.

The DC to DC conversion unit 42 converts the direct current voltage received from the direct current generation unit 41 into direct current power having a voltage different from the output direct current voltage received from the direct current generation unit 41, and supplies the direct current power having the voltage different from the output direct current voltage received from the direct current generation unit 41 to the three-electrode surface discharge type PDP 1 including the driving unit 20. For example, the power supply unit 40 can output direct current power having voltages of 400V, 280V, 60V, −60V, and 5V.

Figure 5:
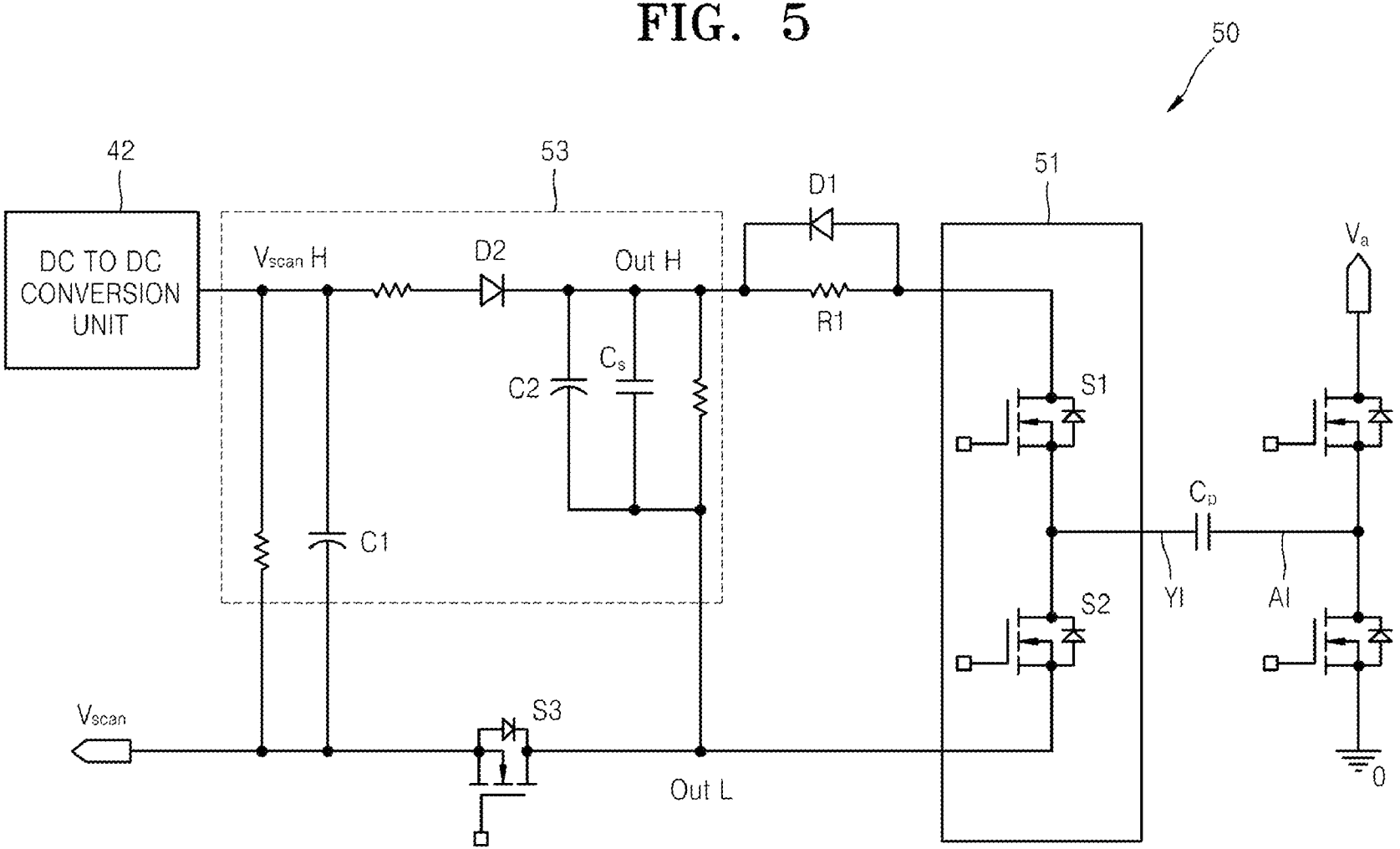
FIG. 5 is a schematic circuit diagram illustrating a driver for a plasma display panel connected to a power supply unit through a bootstrap circuit.
Figure 6:
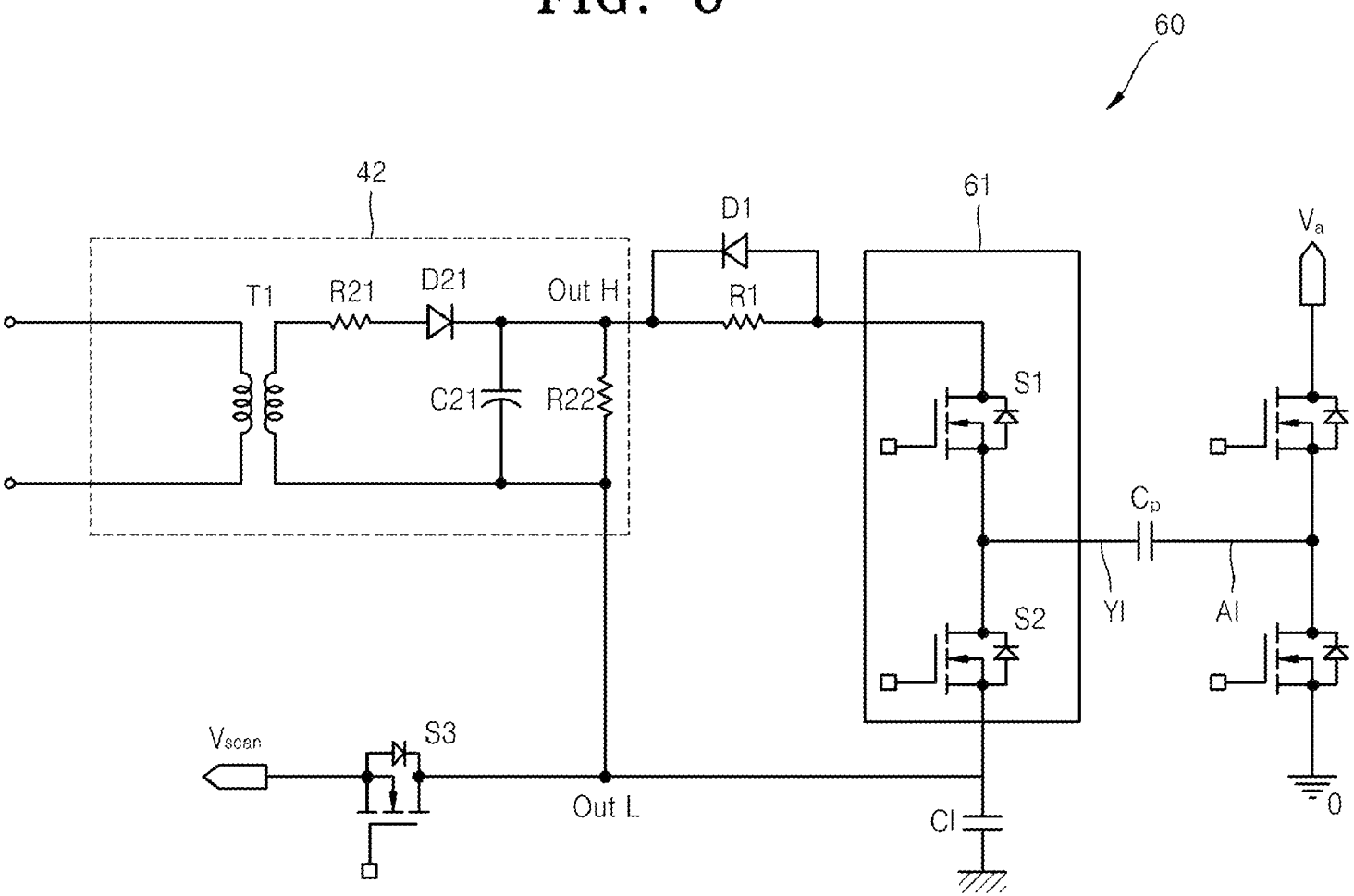
FIG. 6 is a schematic circuit diagram illustrating a driver for a plasma display panel directly connected to a power supply unit without a bootstrap circuit.

FIG. 5 is a schematic circuit diagram illustrating a driver 50 connected to a power supply apparatus for a PDP through a bootstrap circuit 53. FIG. 6 is a schematic circuit diagram illustrating a driver 60 directly connected to a power supply unit for a PDP without a bootstrap circuit 53, according to aspects of the present invention.

The scan driving units 51 and 61 (of FIGS. 5 and 6, respectively) include a first driving switch S1 and a second driving switch S2. The first driving switch S1 of the scan driving units 51 and 61 controls the connection of one terminal Out H of output terminals Out H and Out L of the power supply unit 40 to electrodes YI. The second driving switch S2 of the scan driving units 51 and 61 controls the application of a second output voltage Vscan of a second level to the electrodes YI.

The scan driving units 51 and 61 can be formed by a scan driving IC that includes the first driving switch S1 and the second driving switch S2. A third driving switch S3 controls the connection of a power input terminal of the second output voltage Vscan of the second level to the electrodes YI by being connected between the power input terminal of the second output voltage Vscan of the second level and the second driving switch S2.

In the circuit of FIG. 5, the driver 50 for the three-electrode surface discharge type PDP 1 includes the DC to DC conversion unit 42, the bootstrap circuit 53, the scan driving unit 51, and the third driving switch S3. The bootstrap circuit 53 includes bootstrap capacitors C1 and C2 required for a bootstrap operation.

First, in the bootstrap circuit 53, the first bootstrap capacitor C1 is charged by the first output voltage VscanH when the third driving switch S3 is OFF. Next, the second bootstrap capacitor C2 is charged when the third driving switch S3 is ON. The supply of the second output voltage Vscan is blocked by the OFF operation of the third driving switch S3.

Accordingly, when the scan high voltage VscanH is applied to the scan electrodes in an address period, the voltage Vscan+VscanH corresponding to the sum of the first and second levels can be applied to the electrodes YI when the first driving switch S1 is ON. However, in this case, a complicated bootstrap circuit 53 for applying the scan high voltage VscanH of the first level to the electrodes YI is unnecessary.

Referring to FIG. 6, the drivers 60 for a three-electrode surface discharge type PDP 1 drive a display panel by applying a voltage to electrodes YI, and include a power supply unit 40 (see FIG. 4); a scan driving unit 61, and a third driving switch S3. The power supply unit 40 supplies a first output voltage VscanH of a first level to the electrodes YI and has a pair of output terminals Out H and Out L. The power supply unit 40 includes the direct current generation unit 41 (not shown) and the DC to DC conversion unit 42.

The drivers 60 comprise a diode D1 and a resistor R1 disposed in parallel between one of the terminals of the first driving switch S1 and the terminal Out H of the output terminals Out H and Out L of the power supply. The other terminal of the first driving switch S1 is connected to one of the terminals of the second driving switch S2 and a capacitor Cp. The other terminal of the second driving switch S2 is connected to the terminal Out L of the output terminals Out H and Out L. The other terminal of the capacitor $C_p$ is connected to the address electrodes AI, which are also connected through switches to an address voltage Va and a ground voltage 0. The capacitor $C_p$ corresponds to a location in the PDP 1 in which the electrodes YI and the address electrodes AI cross in the discharge cells 14 of FIG. 1. When the discharge cells 14 are selected, the discharge cells act as a capacitor as charges are built up along the surfaces of the discharge cells 14 during the address period PA of the subfields SF of FIG. 3.

The other terminal Out L of the output terminals Out H and Out L of the power supply unit 40 is connected between the second driving switch S2 and the third driving switch S3. Accordingly, a voltage Vscan+VscanH of a fourth level corresponding to the sum of first output voltage VscanH of the first level and the second output voltage Vscan of the second level can be applied to the electrodes YI when the first driving switch S1 is ON due to the fact that the third driving switch S3 is ON. The second driving switch S2 is OFF when the first driving switch S1 is ON, and the second driving switch S2 is ON when the first driving switch S1 is OFF. At this point, the second output voltage Vscan of the second level corresponding to the scan signal becomes the scan low voltage Vscl of FIG. 3, and the voltage Vscan+VscanH becomes the scan high voltage Vsch of FIG. 3 corresponding to the sum of the first output voltage VscanH of the first level and the second output voltage Vscan of the second level. At this point, the electrodes YI can act as scan electrodes.

However, a driver according to further aspects of the present invention can further include a capacitor CI connected between the second driving switch S2 and the third driving switch S3 and a grounding terminal. The capacitor CI is charged when the third driving switch S3 is ON. In this case, even when the third driving switch S3 is OFF, the voltage Vscan+VscanH corresponding to the sum of the first output voltage VscanH of the first level and the second output voltage Vscan of the second level, corresponding to the scan high voltage Vsch in FIG. 3, can be applied to the electrodes YI by the first driving switch S1 being ON.

In the driver 60 driving a three-electrode surface discharge type PDP 1 according to aspects of the present invention, unlike the circuit of FIG. 5, an additional bootstrap circuit, such as the bootstrap circuit 53 of the driver 50, is not necessary as the DC to DC conversion unit 42 directly supplies the first output voltage VscanH to the electrodes YI to thereby operate the electrodes YI as scan electrodes. The DC to DC conversion unit 42 accepts a voltage at a third level from the direct current generation unit 41. The DC to DC conversion unit 42 comprises a transformer T1. A resistor R21 and the diode D21 are connected in series to one of the terminals of the transformer T1. A capacitor C21 and another resistor R22 are connected in parallel with one end of the parallel capacitor C21 and the another resistor R22 connected between the diode D21 and the terminal Out H and the other end of the parallel capacitor C21 and the another resistor R22 connected between the other terminal of the transformer T1 and the terminal Out L. Accordingly, the circuit of the driver 60 is simplified and thereby reduces costs and enables a stable operation of the circuit of the driver 60.

In a driver for a PDP according to aspects of the present invention, power from a DC to DC conversion unit is directly applied to a scan drive IC without passing through a bootstrap charge system, thereby simplifying the driving circuit.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A plasma display panel, comprising:

a power supply unit that supplies a first output voltage of a first level and has a pair of output terminals;

a scan driving unit that comprises a first driving switch that controls a connection of one of the output terminals of the power supply unit to electrodes of the plasma display panel and a second driving switch that controls a sequential application of a second output voltage of a second level as a scan signal to the electrodes of the plasma display panel during an address period; and a third driving switch that controls a connection of a power input terminal of the second output voltage of the second level to the electrodes of the plasma display panel by being connected between the power input terminal of the second output voltage of the second level and the second driving switch, wherein a voltage different from the first output voltage of the first level and corresponding to a sum of the first output voltage of the first level and the second output voltage of the second level is applied to the electrodes of the plasma display panel when the first driving switch is ON.

2. The plasma display panel of claim 1, wherein the other terminal of the output terminals of the power supply unit is connected between the second driving switch and the third driving switch.

3. The plasma display panel of claim 1, wherein the second driving switch is OFF when the first driving switch is ON.

4. The plasma display panel of claim 1, further comprising a capacitor connected to a grounding terminal and between the second driving switch and the third driving switch.

5. The plasma display panel of claim 1, wherein the power supply unit comprises:

a direct current generation unit that converts an input alternating current voltage into a direct current voltage of a third level; and a DC to DC conversion unit that converts the direct current voltage of the third level into the first output voltage.

6. A plasma display panel, comprising:

a power supply unit that supplies a first output voltage of a first level and has a pair of output terminals;

a scan driving unit that comprises a first driving switch that controls a connection of one of the pair of output terminals of the power supply unit to scan electrodes of the plasma display panel and a second driving switch that controls a sequential application of a second output voltage of a second level as a scan signal to the scan electrodes of the plasma display panel during an address period; and a third driving switch that controls the connection of a power input terminal of the second output voltage to the scan electrodes of the plasma display panel by being connected between the power input terminal of the second output voltage and the second driving switch, wherein a voltage different from the first output voltage of the first level and corresponding to a sum of the first output voltage of the first level and the second output voltage of the second level is applied to the scan electrodes of the plasma display panel when the first driving switch is ON, and wherein the application of the first and second output voltages forms a plurality of subfields with respective gray scale weighted values in frames wherein each subfield comprising a reset period, the address period, and a sustain period; scan signals are sequentially applied to the scan electrodes in the address period; and discharge cells, which are arranged and selected to form an image, are selected by applying data signals to corresponding address electrodes of the discharge cells.

7. The plasma display panel of claim 6, wherein the scan electrodes are biased to a fourth level voltage in the address period, and the scan signals are sequentially applied to the scan electrodes.

8. The plasma display panel of claim 7, wherein the fourth level voltage corresponds to a voltage corresponding to the sum of the first output voltage of the first level and the second output voltage of the second level.

9. The plasma display panel of claim 6, wherein the scan signal is the second output voltage of the second level.

10. The plasma display panel of claim 6, further comprising a capacitor connected to a ground terminal and between the second driving switch and the third driving switch.

11. The plasma display panel of claim 6, wherein the other terminal of the output terminals of the power supply unit is connected between the second driving switch and the third driving switch.

12. The plasma display panel of claim 6, wherein the second driving switch is OFF when the first driving switch is ON.

13. The plasma display panel of claim 6, wherein the power supply unit comprises:

a direct current generation unit that converts an input alternating current voltage into a direct current voltage of a third level; and a DC to DC conversion unit that converts the direct current voltage of the third level into the first output voltage.

14. A plasma display panel, comprising:

scan electrodes to deliver a scan signal to discharge cells;

a scan driving unit having a first driving switch and a second driving switch, wherein the first driving switch and the second driving switch are connected to the scan electrodes;

a third driving switch connected to the second driving switch;

a power supply unit configured to supply a first output voltage of a first level to the first driving switch without a bootstrap circuit and comprising a DC to DC conversion unit, a first terminal, and a second terminal, wherein the first terminal is connected to the first driving switch, and the second terminal is connected between the third driving switch and the second driving switch; and a power input terminal, wherein the power input terminal is connected to sequentially supply a second output voltage of a second level as the scan signal to the scan electrodes via the third driving switch during an address period, wherein a voltage different from the first output voltage of the first level and corresponding to a sum of the first output voltage of the first level and the second output voltage of the second level is applied to the scan electrodes of the plasma display panel when the first driving switch is ON.

15. A method of driving a plasma display panel, comprising:

supplying a first output voltage at a first level from a power supply to a first switch;

applying scan signals to scan electrodes during an address period;

applying address signals in response to the scan signals to select discharge cells;

controlling the application of scan signals with the first switch and a second switch;

sequentially supplying a second output voltage at a second level as the scan signals from a power input terminal to the scan electrodes via a third switch during the address period;

controlling a voltage level of the scan signals with the first, second, and third switches, wherein the third switch controls the application of the second output voltage; and applying a voltage to the scan electrodes of the plasma display panel when the first driving switch is ON, the voltage being different from the first output voltage of the first level and corresponding to a sum of the first output voltage of the first level and the second output voltage of the second level.

16. The method of claim 15, further comprising:

turning the second switch ON when the first switch turns OFF.

17. The method of claim 15, further comprising:

turning the second switch OFF when the first switch turns ON.

18. The method of claim 15, further comprising:

charging a capacitor when the second switch is turned OFF and the third switch is turned ON, the capacitor having a first terminal disposed between the second switch and the third switch and a second terminal electrically coupled to a ground terminal.

* * * * *